US005121879A

United States Patent [19]

Focke et al.

[11] Patent Number: 5,121,879

[45] Date of Patent: Jun. 16, 1992

[54] (FOIL) PACK, ESPECIALLY FOR PAPER TISSUES

[75] Inventors: Heinz Focke, Verden; Alois Mathews, Isernhagen, both of Fed. Rep. of Germany

[73] Assignee: Focke & Co. (GmbH & Co.), Verden, Fed. Rep. of Germany

[21] Appl. No.: 501,209

[22] Filed: Mar. 29, 1990

[30] Foreign Application Priority Data

Apr. 20, 1989 [DE] Fed. Rep. of Germany ..... 3912997
Jun. 20, 1989 [DE] Fed. Rep. of Germany ..... 3920065

[51] Int. Cl.[5] ..... B65D 65/28

[52] U.S. Cl. ..... 229/203; 206/264; 229/87.05; 229/160.2

[58] Field of Search ..... 229/160.2, 123.1, 203, 229/87.05; 206/264, 670, 625, 628

[56] References Cited

U.S. PATENT DOCUMENTS

| | | | |
|---|---|---|---|
| 1,291,984 | 1/1919 | Maloney | 206/628 |
| 1,836,228 | 12/1931 | Dryer | 206/628 |
| 1,895,932 | 1/1933 | Koch | 206/264 |
| 1,915,503 | 6/1933 | Schmidt | 206/264 |
| 2,283,102 | 5/1942 | Stephano | 206/628 |
| 2,346,106 | 4/1944 | Hannigan | 206/264 |
| 3,012,692 | 12/1961 | Petersen . | |
| 3,093,292 | 6/1963 | Ahlbor | 206/264 |
| 3,245,525 | 4/1966 | Shoemaker | 206/264 |
| 3,276,668 | 10/1966 | Tamarin | 206/264 |
| 4,184,597 | 1/1980 | Gavin . | |
| 4,300,676 | 11/1981 | Focke et al. | 206/628 |
| 4,375,260 | 3/1983 | Focke et al. | 206/264 |
| 4,460,088 | 7/1984 | Rugenstein et al. | 206/625 |
| 4,798,295 | 1/1989 | Rausing | 229/160.2 |
| 5,018,625 | 5/1991 | Focke et al. | 729/87.05 |
| 5,040,685 | 8/1991 | Focke et al. | 229/87.05 |

FOREIGN PATENT DOCUMENTS

| | | |
|---|---|---|
| 030601 | 10/1980 | European Pat. Off. . |
| 132250 | 4/1984 | European Pat. Off. . |
| 293360 | 5/1988 | European Pat. Off. . |
| 7934619 | 7/1985 | Fed. Rep. of Germany . |
| 8708274 | 9/1987 | Fed. Rep. of Germany . |
| 8901535 | 5/1989 | Fed. Rep. of Germany . |

*Primary Examiner*—Gary E. Elkins
*Attorney, Agent, or Firm*—Sughrue, Mion, Zinn Macpeak & Seas

[57] ABSTRACT

Folded paper tissues are generally packed in thin foil or film. The pack is provided with a tear-open aid having a tear-open flap (27) limited by perforation lines and an adhesive tape (33) partially covering the tear-open flap. For reasons of better handling and economical production of the pack, the tear-open flap (27) is connected to form a unit with part of the end wall (14), namely with an outer longitudinal flap (25) of the same or an adjoining flap (42) or extension (43) formed by the end wall, which can be moved with the aid of the adhesive tape into opening and closing position. In connection with the folding of the end wall (14), the design of the tear-open aid creates an advantageous extraction opening (37) by means of the given width of an inner longitudinal flap (26).

4 Claims, 9 Drawing Sheets

(FOIL) PACK, ESPECIALLY FOR PAPER TISSUES

BACKGROUND OF THE INVENTION

The invention relates to a (foil) pack, especially for paper tissues, having a tear-open flap as an opening aid provided on the upper side with an adhesive tape (or adhesive label), and being limited by lateral perforation lines.

Paper tissues are usually offered in cuboidal packs made of very thin plastic foil or film. Such a pack generally contains ten folded paper tissues.

For some time now, the foil packs have been provided with tear-open aids, mainly of the reclosable type. An especially widespread foil pack of this type has a tear-open flap limited by perforation lines in the region of a (large-surfaced) front wall of the pack. This tear-open flap extends in the direction of an (upper, small-surfaced) end wall. An end region of the tongue-shaped tear-open flap is provided with an adhesive tape, which can be pulled off the front wall with an adhesive-free grip end, thus also pulling the tear-open flap. Herewith, an (upper) extraction opening for the tissues is exposed.

Other embodiments of such foil packs are also known, for example one having a reclosable tear-open aid provided with an adhesive tape in the region of an elongated side wall of the pack.

SUMMARY OF THE INVENTION

The invention is concerned with such cuboidal (foil) packs, especially for paper tissues. The object of the invention is to form a pack provided with a reclosable tear-open aid such that two things are guaranteed, namely an economical industrial production and easiest possible handling for the consumer.

In order to attain this object, the pack according to the invention is characterized in that the tear-open flap has an extension which extends in a wall transverse to the wall having the tear-open aid and which is connected to the adhesive tape (adhesive label) such that for opening the pack, first the extension and then the tear-open flap are moved into opening position.

Preferably, the extension of the tear-open flap is a folding flap within the adjacent and adjoining wall of the packs. When the pack is opened, the folding flap, via the adhesive tape, is therefore moved out of the closing or wall plane first. Then, the perforation limiting the tear-open flap is severed. Now, a unit formed by the tear-open flap and the adjoining folding flap can be moved for forming an extraction opening. Thus, an extraction opening is formed extending within the wall with the tear-open flap and within the adjoining transversely oriented wall. In the preferred embodiment of the invention, the tear-open flap is located in a large-surfaced front wall of the cuboidal pack, in a region next to a small-surfaced end wall. The extension adjoining the tear-open flap is an outer folding flap of the end wall or part of the same. Part of the adhesive tape is joined to the folding flap and furthermore to part of the face of the end wall and the adjoining rear wall. Hence, the pack is opened and in reverse order reclosed via the end wall by pulling the adhesive tape from the rear wall and lifting the outer folding flap and finally by operating the tear-open flap.

It is also of advantage to fold the blank for forming the pack such that in the region of the end wall, side flaps extending from the side walls are first folded against the pack contents and then trapezoidal longitudinal flaps are folded so as to partially overlap. The outer trapezoidal longitudinal flap adjoins to the tear-open flap of the front wall and is connected to the adhesive tape. The invention further provides that the side flaps can be severed from the outer longitudinal flap during the opening process by means of a perforation line.

In a particularly advantageous embodiment of the pack, the tear-open flap or its extension extends within the trapezoidal longitudinal flap of the end wall up to the free edge of the longitudinal flap, with a width being slightly smaller than that of the longitudinal flap 25. By means of appropriate, especially by diverging perforation lines (side perforations), a tear-open flap extending from the free edge of the longitudinal flap up to the front wall of the pack with corresponding extraction opening can be formed.

Further details of the invention are described below with reference to the drawings which show:

DETAILED DESCRIPTION OF PREFERRED EMBODIMENTS

Figure 1:
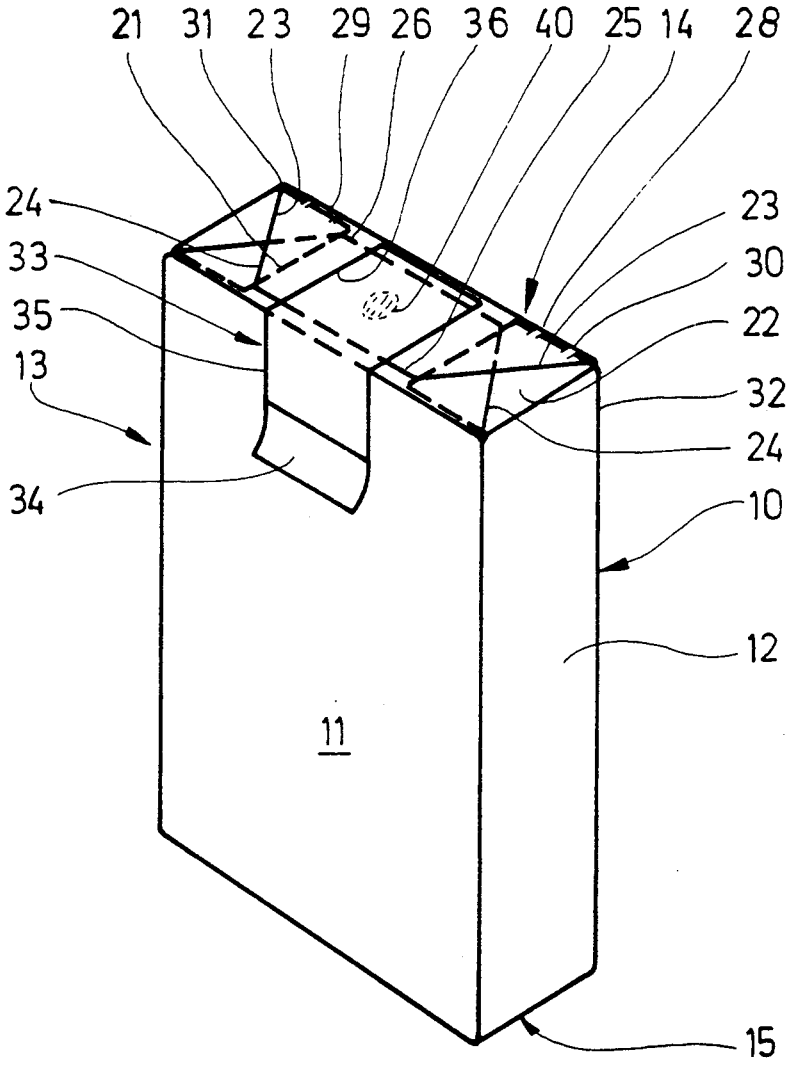
FIG. 1 a perspective view of a preferred embodiment of a reclosable (foil) pack, especially for paper tissue, FIG. 2 a perspective view of the pack according to FIG. 1 with opened flap FIG. 3 a section of the foil web with blanks for a pack according to FIGS. 1 and 2, FIG. 4 a perspective view of another embodiment of the pack with closed flap, FIG. 5 the pack according to FIG. 4 with opened flap, FIG. 6 a section of the foil web with blanks for the packs according to FIGS. 4 and 5, FIG. 7 a perspective view of a third embodiment of the pack with closed flap, FIG. 8 a front view of the pack according to FIG. 7 with opened flap, FIG. 9 a section of a foil web with blanks for packs according to FIGS. 7 and 8.
Figure 2:
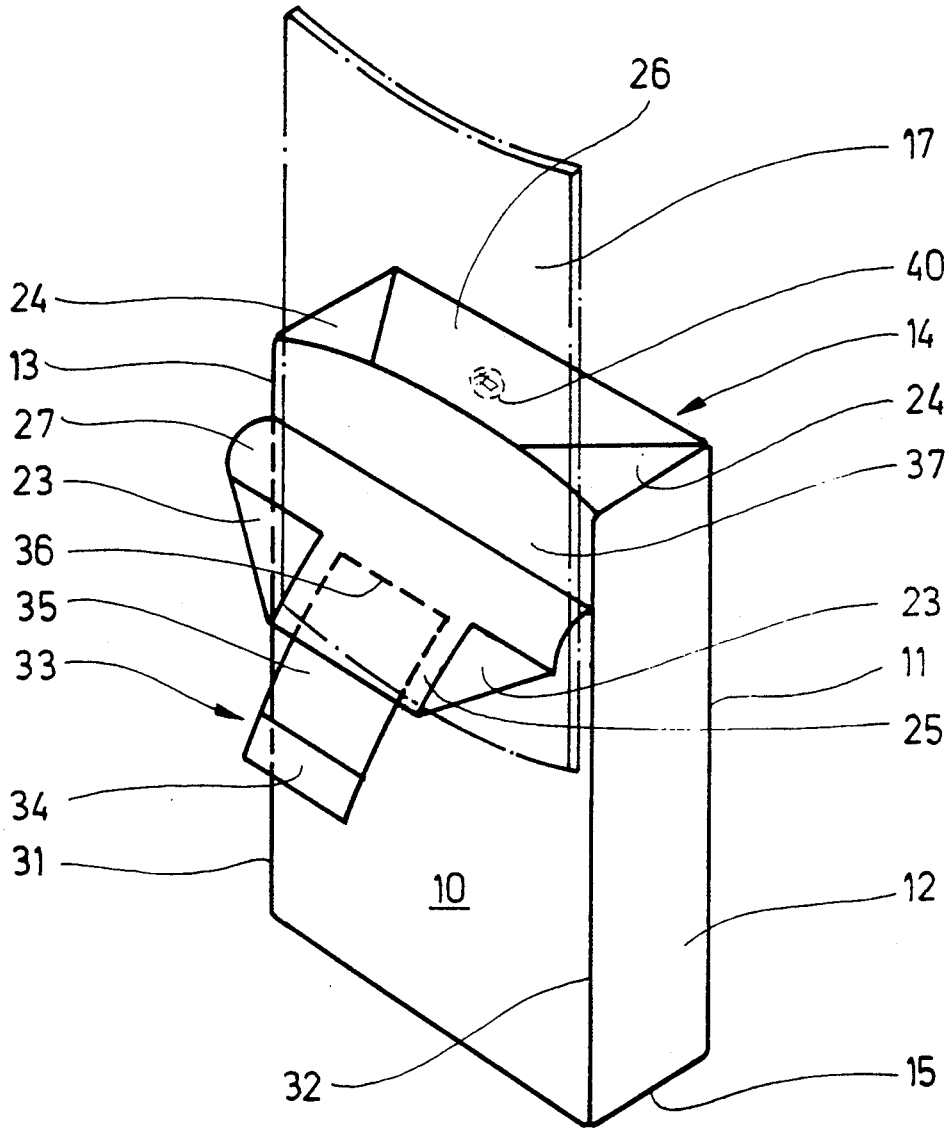
Figure 3:
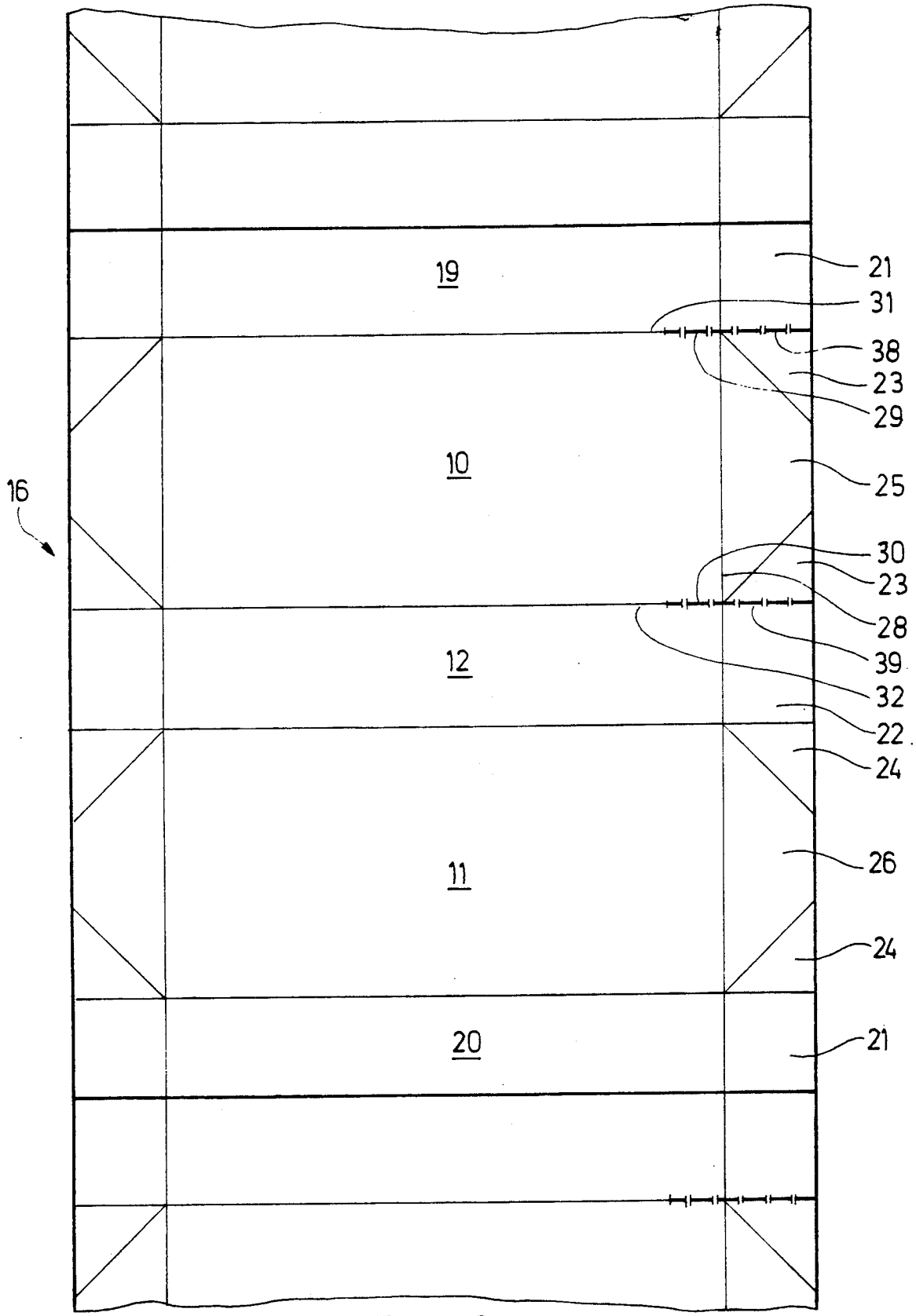

The pack according to FIGS. 1 and 2 is of cuboidal shape with a large-surfaced rectangular front wall 10 and a correspondingly formed rear wall 11. Inbetween front and rear wall are elongated side walls 12 and 13, an upper end wall 14 consisting of folding flaps and a correspondingly formed bottom wall 15. The pack formed this way is made of a rectangular blank 16 consisting of thin plastic foil or film of for instance 30μ or more. The pack serves for holding folded paper tissues 17 arranged in a stack. The blank 16 is shown in FIG. 3 as a section of a foil web 18. Surface portions for forming the above-described pack walls and folding flaps are marked by lines. The blank is folded over the side wall 12 around the stack of paper tissues 17 in a U-shaped manner. Side wall flaps 19 and 20 formed at the free edges overlap one another and are joined to one another for forming the (double-layered) side wall 13, especially by thermal sealing.

Blank portions projecting above and below form folding flaps for the end wall 14 and the bottom wall 15. Side flaps 21 and 22 extending from side walls 12 and 13 are first folded into the plane of end wall 14 and bottom wall 15. Herewith, triangular tabs 23, 24 are formed at the inside of longitudinal flaps 25 and 26. Because of the particular folding geometry, said longitudinal flaps 25, 26 are formed trapezoidally. First, the inner longitudinal flap 26 connected to the rear wall 11 is folded, pulling with it the assigned tabs 24. Then, the outer longitudinal flaps 25 are folded with the tabs 23 into the plane of the end wall 14 and bottom wall 15. Large portions of the longitudinal flaps 25, 26 cover one another, as is shown by FIG. 1.

The pack is equipped with a tear-open aid. For this purpose, a tear-open flap 27 (FIG. 2) is formed in the region of the front wall 10. This tear-open flap 27 directly adjoins the end wall 14, that is to say to a front edge 28 (FIG. 1) formed between front wall 10 and end wall 14. The tear-open flap 27 is laterally limited by perforations, namely by flap perforations 29, 30 (FIG. 1) in the present embodiment, these flap perforations 29, 30 extend at the edges of the front wall 10, specifically in the region of upright longitudinal edges 31, 32 of the pack. The length of the flap perforations 29, 30 is limited, so that a tear-open aid 27 of a relatively small height of for example 1 cm or more is formed.

A portion of the tear-open flap 27 extending beyond the front edge 28 is connected to part of the upper end wall 14, namely to the outer longitudinal flap 25. Consequently, this longitudinal flap 25 is moved out of and back into closing position together with the tear-open flap 27.

The tear-open aid also comprises an adhesive tape 33, which is here designed as a rectangular strip portion, but can also be of other geometrical shapes. One side of the adhesive tape is coated with a (durable) adhesive by means of which said adhesive tape is connected to the pack.

The adhesive tape 33 is attached to the pack in a special place or special relative position. At the free end of the adhesive tape 33 there is an adhesive-free grip flap 34 for operating the adhesive tape 33. A leg 35 of the same—with the grip flap 34—is connected to the rear wall 11. A further leg 36 extends in the region of the upper end wall 14, such that a major portion of this leg 36 of the adhesive tape 33 is connected to the longitudinal flap 25.

When the pack is opened, the grip flap 34 is grasped and then the leg 35 pulled off the rear wall 11. During the further process of operating the adhesive tape 33, the longitudinal flap 25 is lifted from the position in the plane of the front upper end 14. Thereafter, the tear-open flap 37 is severed out of the front wall 10 by destroying the perforation lines (flap perforations 29, 30). In a downwardly directed position of the tear-open flap 27 (with longitudinal flap 25 and adhesive tape 33), an extraction opening is exposed in the region of the front wall 10, said extraction opening in this embodiment extending across the full width of the front wall 10 and including a side tab portions of the upper end wall 14. Thus, an easy extraction of the paper tissues without any need of force is made possible.

The pack is reclosed by pivoting the tear-open flap 27 and the longitudinal flap 25 back into initial position and by sticking the adhesive tape 33 (leg 35) to the rear wall 11. The described opening process is made possible because the tabs 23 can be removed from the plane of the end wall 14 together with the longitudinal flap 25 which they are assigned to. For this purpose, perforation lines 38, 39 (FIG. 3) extending from the flap perforations 29, 30 are disposed in the region of a folding edge between the side flaps 21 and 22 on the one hand and the tabs 23 on the other hand. After the end wall 14 is folded, these perforation lines 38, 39 extend in the front edge 28 or parallel to the same. When the pack is opened by lifting the longitudinal flap 25, the perforation lines 38, 39 are severed, so that the tabs 23 are severed from the side flaps 21, 22 and lifted together with the longitudinal flaps 25 (FIG. 2).

The folding flaps forming the upper end wall 14 are expediently partially connected to one another gluing or sealing. In the region of the tabs 24, the longitudinal flap 26 can be connected to said tabs as well as to the side flaps 21 and 22 by sealing. It is also of advantage, if the outer longitudinal flap 25 is connected to one or several of the other folding flaps such that the connection is removed or destroyed when the pack is opened. The shown embodiment has a longitudinal flap 25 which is joined by a spot-shaped connection, namely by a spot-seal 40, to the inner longitudinal flap 26. When the pack is opened, namely when the longitudinal flap 25 is lifted, this spot-seal 40 is torn apart so that the longitudinal flap 25 is released. Additionally, the tabs 23 can be connected to the longitudinal flaps 25 by sealing.

Figure 4:
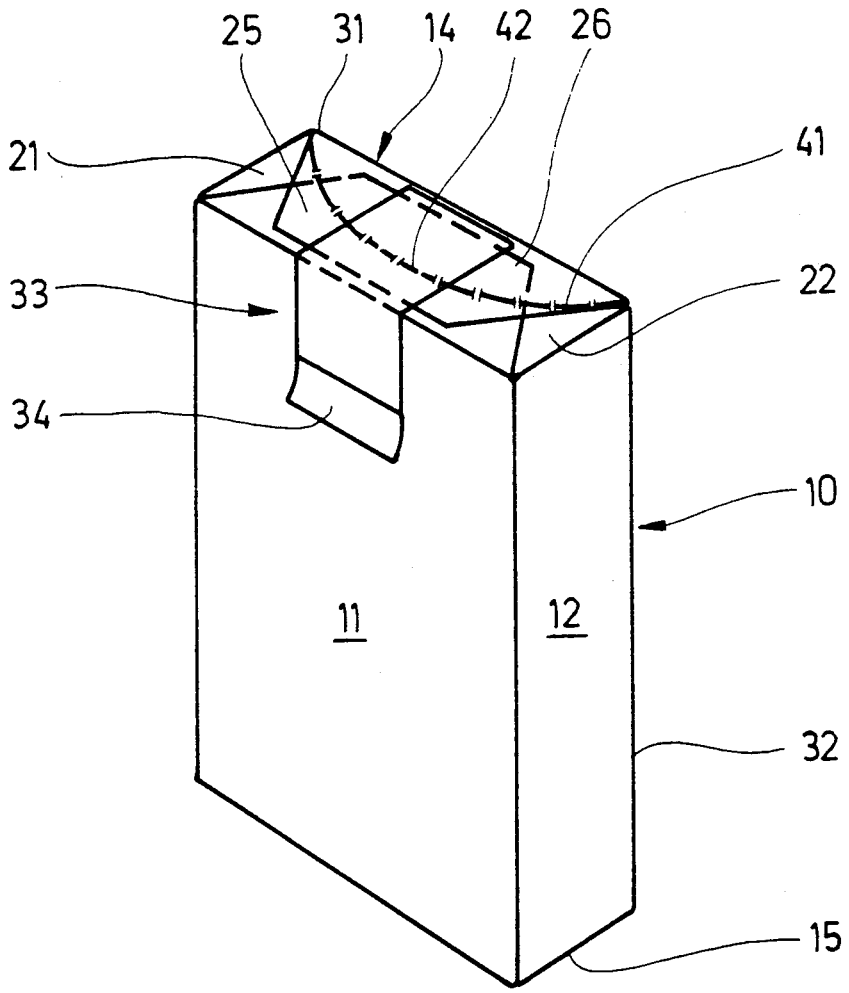
Figure 5:
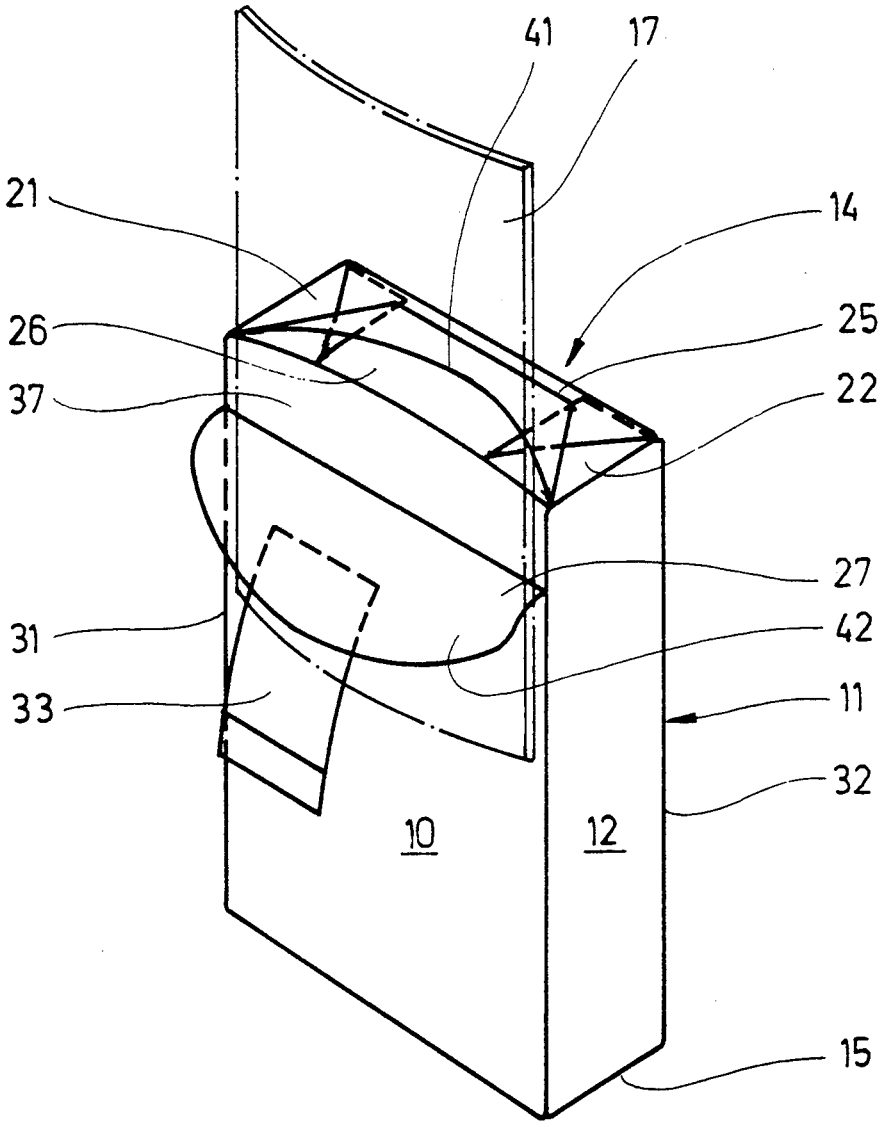
Figure 6:
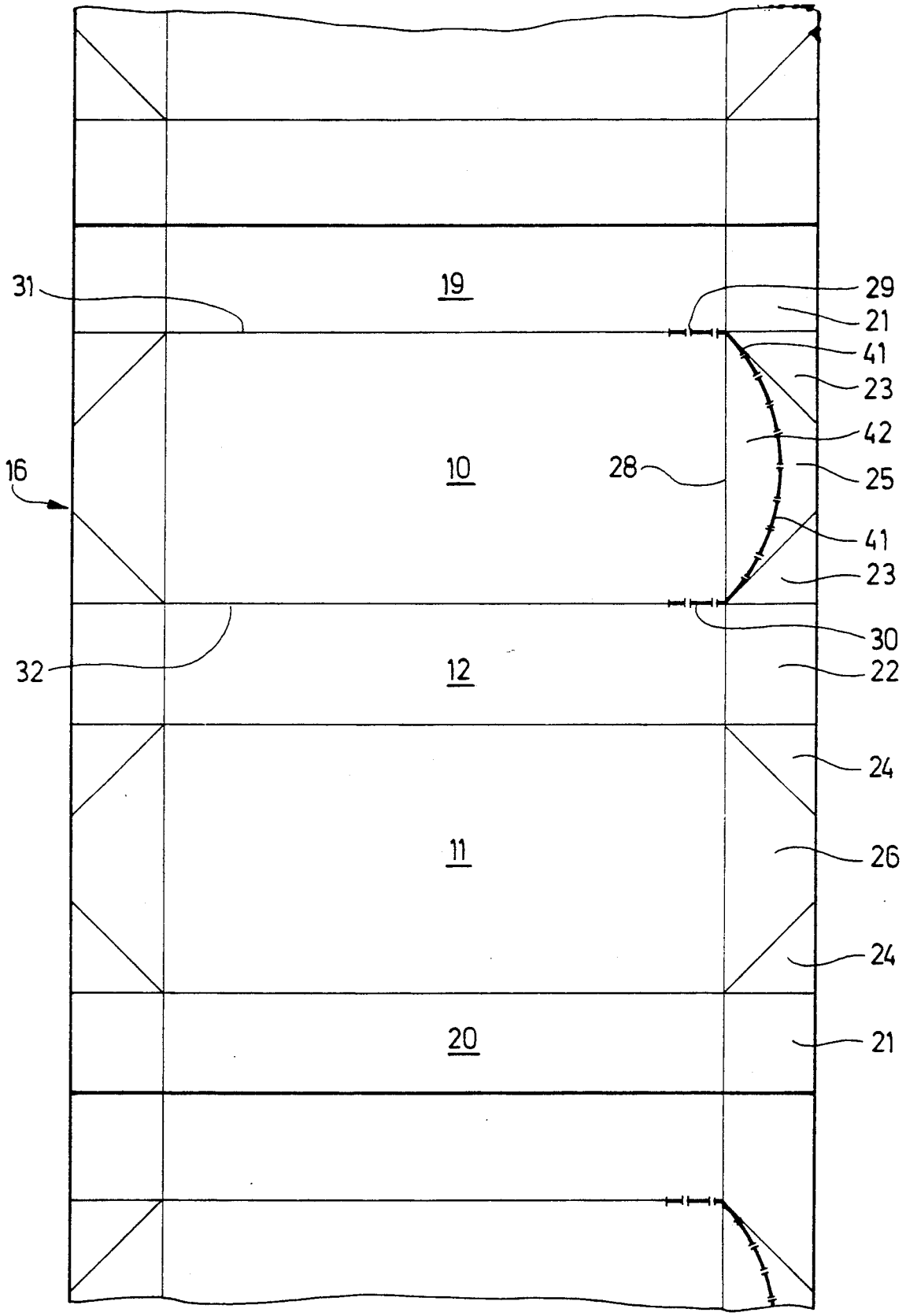

FIGS. 4, 5 and 6 show details of a pack which mainly corresponds to the embodiment shown by FIGS. 1 to 3, the difference being the design of the tear-open aid. In the region of the upper end wall 14, an adjoining flap 42 is formed, being an extension of the tear-open flap 27 and also being limited by a perforation line 41. The middle region of this adjoining flap 42 is covered by the adhesive tape 33 or by the leg 36 assigned to the end wall 14. When the adhesive tape 33 is pulled off, first the adjoining flap 42 is torn out of the connection with the end wall 14 by removing the perforation line 41. Thereafter, the tear-open flap 42 is pulled off in the region of the front wall 10 in the described way.

In the presently discussed embodiment, the adjoining flap 42 limited by a curved perforation line 41 is part of the outer longitudinal flap 25. In order to improve stability, surface portions of this longitudinal flap 25 lying beyond the adjoining flap 42 can be (firmly) joined to the inner longitudinal flap 26 by sealing or the like.

Figure 7:
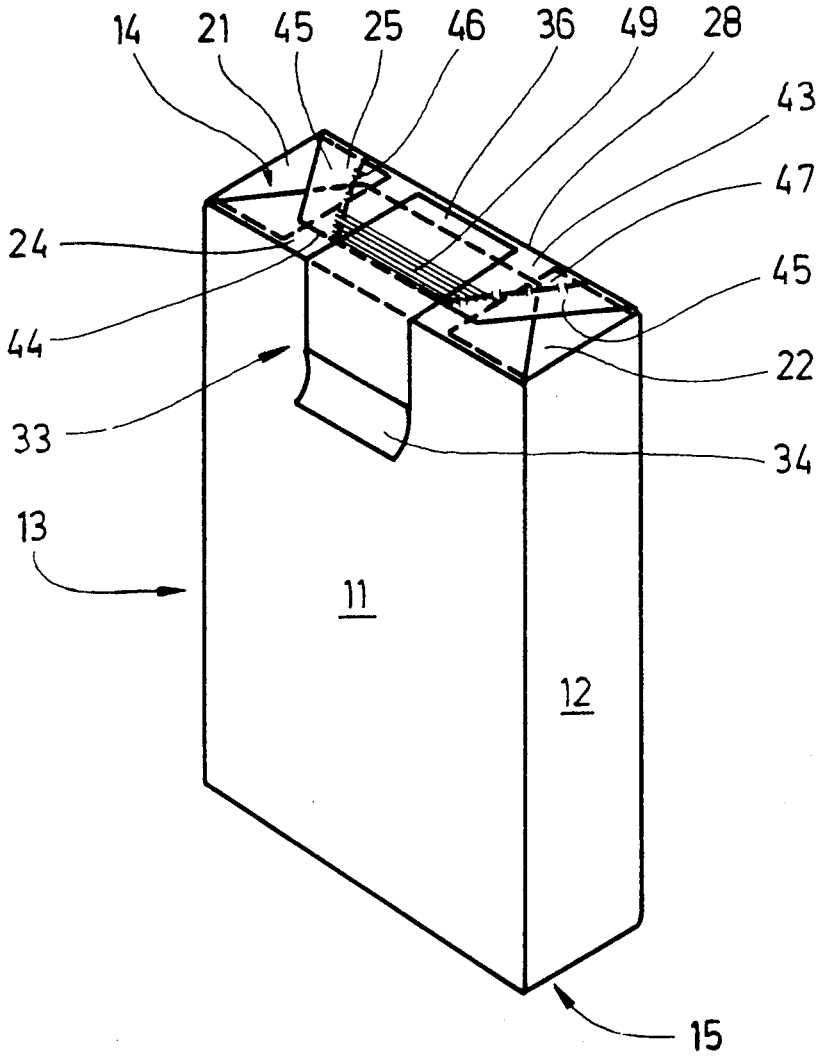
Figure 8:
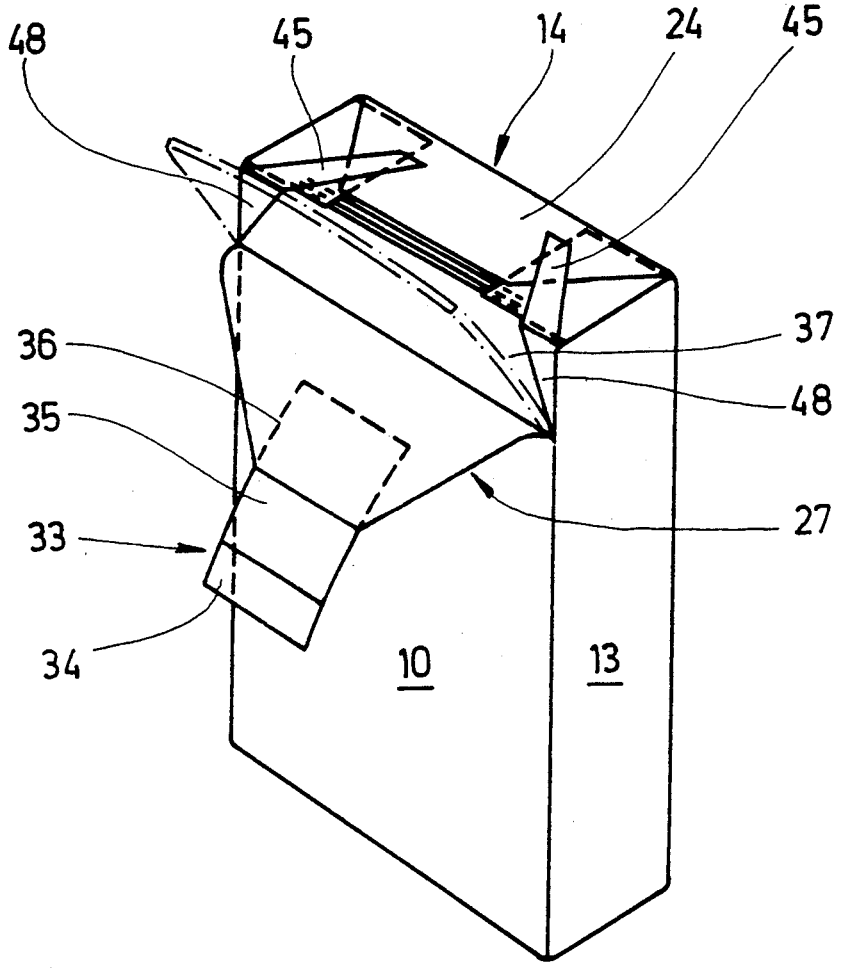
Figure 9:
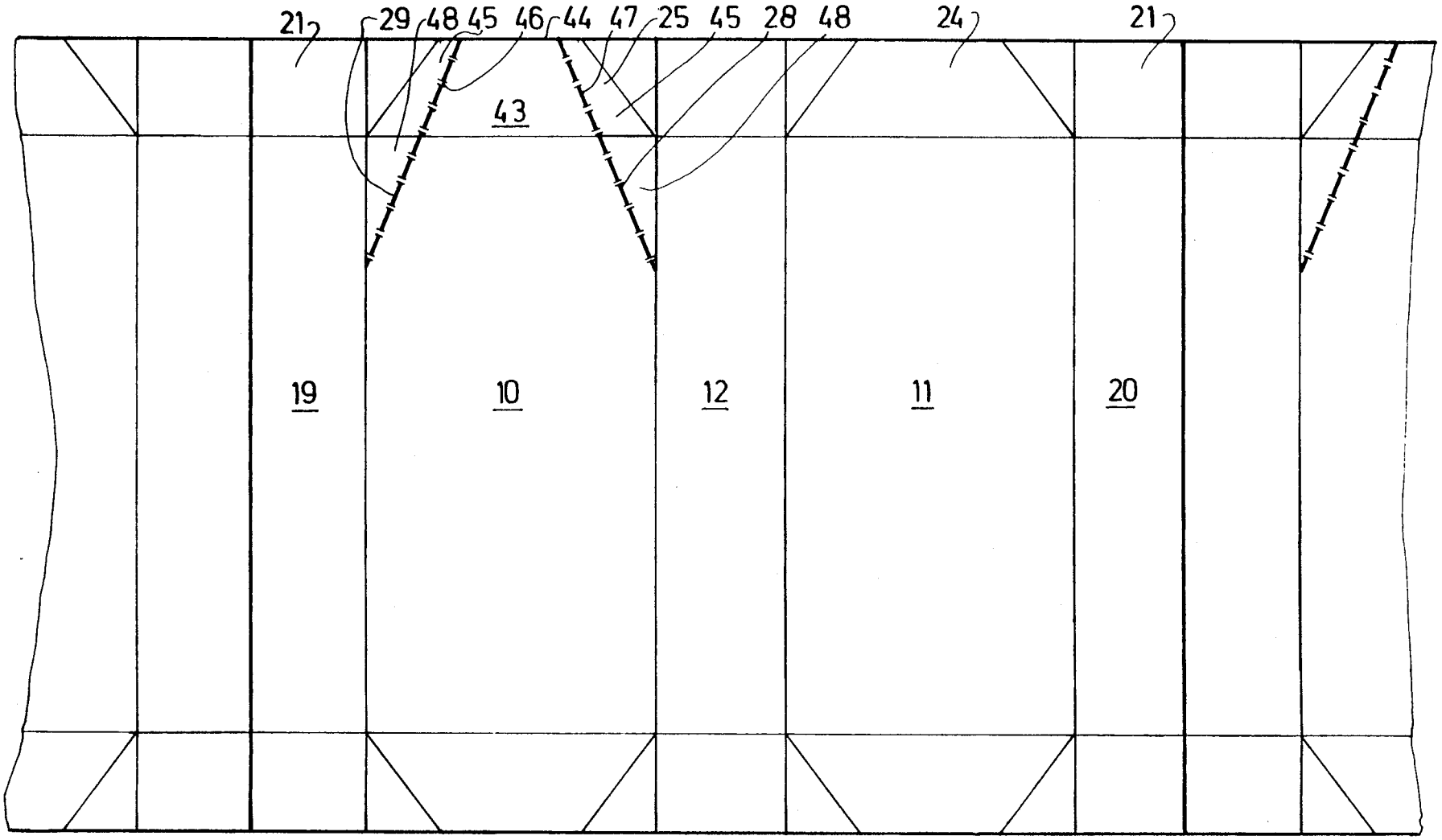

A further development of the afore embodiment is shown by FIGS. 7 to 9. The tear-open aid which in this embodiment is also formed in the front wall 10 has an extension 43 being part of the longitudinal flap 25 of the adjoining upper end wall 14. This extension 43 extends up to a free edge 44 of the trapezoidal longitudinal flap. The width of the extension 43 is significantly smaller than the length of the longitudinal flap 25, so that when the pack is opened, side strips 45 of the longitudinal flap 25 are retained in the plane of the front wall 14 by means of a durable connection (thermal sealing, adhesive bonding) to the folding flaps of the end wall 14 lying underneath, namely to longitudinal flap 26 and side flaps 21, 22.

In the region of the longitudinal flap 25, the extension 43 of the tear-open flap 27 is limited by side perforations 46, 47, which diverge from the free edge 44 up to the front edge 28, where the side perforations 46, 47 merge into the flap perforations 29, 30 for laterally limiting the tear-open flap in the region of the front wall 10.

The shown preferred embodiment has side perforations 46, 47 in the region of the longitudinal flap 25 which form a rectilinear continuation of the flap perforations 29, 30 which are also converging here in direction of the front edge 28. Hence, these flap perforations 28, 29 form together with the side perforations 46, 47 rectilinear and continuous perforations (FIG. 9). Said flap perforations 29, 30 terminate in the region of the front wall 10 at the longitudinal edges 31, 32, so that in this region—at a distance from the front edge 28—there extends the extraction opening across the full width of the front wall 10. In a lateral region adjacent to the front edge 28, on the other hand, there remain, even when the pack is opened, corner tabs 48 which add to the stability of the pack.

The middle region of the longitudinal flap 25 corresponding to the width of the extension 43 is expediently provided on its bottom side with a coating 49 which prevents the longitudinal flap 25 or the extension 43 from being tightly sealed to folding flaps lying underneath. This coating 49 can be a lacquer coating, a printing or the like.

One of the reasons that the extraction opening 37 exposed in all embodiments guarantees easy access to the pack contents, i.e. to the respective foremost paper tissue 17, is that the longitudinal flaps 25, 26 are of a smaller width then the upper end wall 14. Because of this, the inner longitudinal flap is set back from the front edge 28 when the pack is open and thus enlarges the extraction opening 37 in this region.

What is claimed is:

1. In a soft cuboidal pack, especially for paper tissues, comprising at least an upper end wall, a front wall and a rear wall, the improvement wherein:

a part of said front wall (10) comprises a tear-open flap (27) which serves as a pack-opening aid;

said tear-open flap (27) has an adjoining flap extension;

an adhesive tape (33) lies on an outside surface of said flap extension;

said flap extension extends into a region of said end wall (14) and forms at least a part thereof, said end wall (14) adjoining said front wall (10) and being directed transversely thereto;

for opening part of said end wall (14) as well as said front wall (10) to form a pack-contents extraction opening, first said flap extension and, then, said tear-open flap (27) are operable to be moved from a closed position into an opening position;

said end wall (14) is formed by side flaps (21, 22), which extend from side walls (12, 13) of the pack and which are folded into a plane of said end wall (14), and by outer and inner longitudinal folding flaps (25 and 26) adjoining the front wall (10) as well as the rear wall (11);

the outer longitudinal folding flap (25) is joined to said front wall (10) and is connected to, and operable together with, said tear-open flap (27);

said tear-open flap (27) is delimited by lateral flap perforations (29, 30) extending along upright longitudinal edges (31, 32) of said front wall (10);

said flap extension of said tear-open flap (27) is a part (42) of said outer longitudinal folding flap (25) and is delimited by a perforation line (41); and said flap extension is severable along the perforation line (41) from said outer longitudinal folding flap (25), except for an area where said tear-open flap (27) and said flap extension adjoin one another.

2. The pack according to claim 1, wherein the perforation line (41) extends to ends of said longitudinal edges (31, 32) and merges into said flap perforations (29, 30).

3. In a soft cuboidal pack, especially for paper tissues, comprising at least an upper end wall, a front wall and a rear wall, the improvement wherein:

a part of said front wall (10) comprises a tear-open flap (27) which serves as a pack-opening aid;

said tear-open flap (27) has an adjoining flap extension;

an adhesive tape (33) lies on an outside surface of said flap extension;

said flap extension extends into a region of said end wall (14) and forms at least a part thereof, said end wall (14) adjoining said front wall (10) and being directed transversely thereto;

for opening part of said end wall (14) as well as part of said front wall (10) to form a pack-contents extraction opening, first said flap extension and, then, said tear-open flap (27) are operable to be moved from a closed position into an opening position;

said end wall (14) is formed by side flaps (21, 22), which extend from side walls (12, 13) of the pack and which are folded into a plane of said end wall (14), and by outer and inner longitudinal folding flaps (25 and 26) adjoining the front wall (10) as well as the rear wall (11);

the outer longitudinal folding flap (25) is joined to said front wall (10) and is connected to, and operable together with, said tear-open flap (27); and said flap extension of said tear-open flap (27) is joined by a releasable connection (40) to the inner longitudinal folding flap (26) before the pack is opened.

4. In a soft cuboidal pack, especially for paper tissues, comprising at least an upper end wall, a front wall and a rear wall, the improvement wherein:

a part of said front wall (10) comprises a tear-open flap (27) which serves as a pack-opening aid;

said tear-open flap (27) has an adjoining flap extension;

an adhesive flap (33) lies on an outside surface of said flap extension;

said flap extension extends into a region of said end wall (14) and forms at least a part thereof, said end wall (14) adjoining said front wall (10) and being directed transversely thereto;

for opening part of said end wall (14) as well as part of said front wall (10) to form a pack-contents extraction opening, first said flap extension and, then, said tear-open flap (27) are operable to be moved from a closed position into an opening position;

said end wall (14) is formed by side flaps (21, 22), which extend from side walls (12, 13) of the pack and which are folded into a plane of said end wall (14), and by outer and inner longitudinal folding flaps (25 and 26) adjoining the front wall (10) as well as the rear wall (11);

the outer longitudinal folding flap (25) is joined to said front wall (10) and is connected to, and operable together with, said tear-open flap (27);

said tear-open flap (27) extends to a free edge of the outer longitudinal folding flap (25) as a part thereof and is delimited by side perforations (46, 47) extending at a distance from side edges of said outer longitudinal folding flap (25);

said tear-open flap (27) is delimited by lateral flap perforations (29, 30) extending along upright longitudinal edges (31, 32) of said front wall (10); and said flap perforations (29, 30) adjoin said side perforations (46, 47) in a region of said outer longitudinal folding flap (25), as continuously diverging perforation lines.

* * * * *